US007070054B2

(12) United States Patent
Scrymgeour et al.

(10) Patent No.: US 7,070,054 B2
(45) Date of Patent: Jul. 4, 2006

(54) PRODUCT PACKAGING HAVING A REMANENT VALUE

(75) Inventors: Lyle Harold Scrymgeour, Winnipeg (CA); Michael John Brickwood, Winnipeg (CA)

(73) Assignee: Pollard Banknote Limited Partnership, Winnipeg (CA)

( * ) Notice: Subject to any disclaimer, the term of this patent is extended or adjusted under 35 U.S.C. 154(b) by 192 days.

(21) Appl. No.: 10/736,226

(22) Filed: Dec. 16, 2003

(65) Prior Publication Data

US 2005/0127602 A1 Jun. 16, 2005

(51) Int. Cl.
*B65D 85/00* (2006.01)

(52) U.S. Cl. ..... 206/459.5; 206/831; 283/94

(58) Field of Classification Search ..... 283/81, 283/94, 100, 101, 103; 273/139; 426/106, 426/122, 123, 306; 206/459.1, 232, 831, 206/459.5

See application file for complete search history.

(56) References Cited

U.S. PATENT DOCUMENTS

| | | | | |
|---|---|---|---|---|
| 4,432,153 | A * | 2/1984 | Bachman et al. | 40/324 |
| 5,137,148 | A * | 8/1992 | Evers | 206/271 |
| 5,217,258 | A | 6/1993 | Sanderson | |
| 5,653,473 | A * | 8/1997 | Laszutko et al. | 283/81 |
| 5,697,549 | A * | 12/1997 | Yocum | 229/400 |
| 6,053,497 | A | 4/2000 | Such | |
| 6,234,477 | B1 | 5/2001 | Scrymgeour et al. | |
| 6,318,760 | B1 * | 11/2001 | Shadle et al. | 283/95 |
| 6,436,500 | B1 * | 8/2002 | Yingst et al. | 428/40.1 |
| 6,594,927 | B1 * | 7/2003 | Witkowski | 40/310 |
| 6,736,262 | B1 * | 5/2004 | Focke et al. | 206/268 |
| 6,749,229 | B1 * | 6/2004 | Kennedy | 283/56 |
| 2004/0256274 | A1 * | 12/2004 | Betsch | 206/484 |

FOREIGN PATENT DOCUMENTS

| | | |
|---|---|---|
| CA | 2229837 | 2/1998 |
| CA | 2241241 | 3/2003 |

* cited by examiner

*Primary Examiner*—David T. Fidei
(74) *Attorney, Agent, or Firm*—Adrian D. Battison; Michael R. Williams; Ryan W. Dupuis

(57) ABSTRACT

A packaging material is provided in a continuous roll for forming into a channel shaped receptacle for receiving and supporting a structure such as a food product to be packaged by an over-wrap material. The packaging material is formed from two substrate sheets connected together along side edges to form a coextensive laminate defining a center portion and two side strip portions where the center portion has a width arranged to form the bottom wall and the two side strip portions each have a width arranged to form a respective one of the upstanding side walls. The center portions can be separated and exposed by tearing away the side and end portions and the inside surface of the center portions carries printed indicia providing a remanent value therefor, such as a scratch-off type lottery game or a collectible card.

29 Claims, 9 Drawing Sheets

PRODUCT PACKAGING HAVING A REMANENT VALUE

The present invention relates generally to a printed substrate which can be used in product packaging to provide a remanent value and to a packaged product using the printed substrate.

BACKGROUND OF THE INVENTION

In U.S. Pat. No. 6,234,477 assigned to the present assignee and issued May 22, 2001 is disclosed a construction of lottery or game ticket which utilizes variable image printing techniques in combination with lamination of two substrate sheets together to form what is initially a common pouch construction with the game indicia on the inside surface where the sheets can be separated, each from the other, to form in effect two separate tickets.

The above patent and many similar patents and products available on the marketplace generally provide simply a lottery or game ticket printed on a suitable single substrate sheet or on laminated sheets where the tickets are intended to be used individually simply for playing of a game and are then discarded.

Many such tickets are used directly in a lottery situation so that the tickets have no other relevance other than the playing of the lottery or game by which the player may win monetary or other prizes as part of the lottery or gaming situation.

However more attention has been recently given to the use of such tickets as promotional items used by manufacturers of other products to enhance the sale of the product. It is common therefore for such products to include prize winning elements to encourage the purchase of the particular product. Thus bottled products sometimes include a prize winning element located within the cap. Thus boxed products such as cereal often include an additional insert card placed within the box which carries a game or other promotional material. In such situations, the card is merely an addition to the product and does not form part of the packaging itself.

There is however a desire to form such cards or tickets as part of a packaging material to provide the purchaser with the perception that the card or ticket is an integral part of the product and to provide the customer with the perception that there is an attempt to avoid wastage of materials.

SUMMARY OF THE INVENTION

It is one object of the present invention to provide a packaged product where a part of the packaging material is arranged conveniently to form a card or ticket which retains a remanent value to the purchaser thus providing the possibility for the supplier of the product to use the card or ticket for promotional materials enhancing the sale of the product.

According to a packaged product comprising:

at least one product arranged to form a structure to be packaged;

a channel shaped receptacle for receiving and supporting the structure to be packaged;

the channel shaped receptacle having a bottom wall on which the structure sits, with two side edges and two end edges defining a width and length of the bottom wall generally matching a width and length of the structure;

the channel shaped receptacle having two upstanding side walls each connected along a respective side edge of the bottom wall so as to stand upwardly therefrom to a height to provide protection for sides of the structure;

and an over-wrap material covering the channel shaped receptacle and the structure thereon;

the channel shaped receptacle comprising:

a first substrate sheet having a front surface and a rear surface;

a second substrate sheet having a front surface and a rear surface;

the rear surface of at least one of the first and second substrate sheets having printed thereon indicia providing a remanent value therefor;

the first and second substrate sheets being coextensive, with the rear surface of the first substrate sheet being connected to the rear surface of the second substrate sheet to form a common assembly for forming the channel shaped receptacle;

either the first substrate sheet alone or both substrate sheets being perforated to define a perforated tear line thereon arranged to define a portion of the first substrate sheet which can be opened relative to the second substrate sheet, by a user tearing through the perforated tear line, to expose the indicia.

The side walls of the channel shaped receptacle may be of a height which matches the height of the structure to provide protection for the sides of the structure, but a lower height may in some cases be acceptable for some products. The side walls and the bottom wall also preferably have some stiffness which acts to maintain the channel shape but the amount of stiffness is open to adjustment or selection by varying the thickness and material of the substrate sheets, as will be well known by one skilled in this art. Such packaging structures are commonly used with a thin flexible over-wrap material so that the majority of the stiffness is provided by the channel shaped receptacle but again this can vary depending upon the type of product to be packaged and other factors well know to a person skilled in this art.

The perforations described herein can be provided either through the first substrate sheet alone or through both substrate sheets provided that the sheets can be separated as required herein. The term "perforations" is not intended to require complete perforation through the structure but is a common term of art to define a line of weakness which allows tearing at the line so formed.

The two substrate sheets can be "opened" by complete separation of one from the other or by providing an opening which is sufficient in size to allow the user or player to access the indicia printed on the inside or rear surface of one or both substrate sheets.

It is a highly desirable feature that two side portions of the perforated tear line are arranged respectively along the side edges of the bottom wall. This allows the formation of the remanent portion of the packaging which is defined solely by the flat center portion of the substrate sheets with the folded or bent side portions fully torn away. It will be appreciated that this provides the most aesthetic construction for the user so that the remanent substrate whether that be a game or other collectible is flat. However this is not an essential requirement and the fold lines may not be located directly at the tear lines. Minimizing the width of the side portion torn away of course maximizes the width of the remanent center portion and thus the area available for the indicia, and in some cases this requirement may over-rule the desirability for a flat substrate piece.

Of course, where the two portions of the perforated tear line are arranged along the side edges of the bottom wall such that the channel shaped receptacle can be torn along the side edges of the bottom wall to simultaneously remove the upstanding side walls and separate the first substrate sheet from the second substrate sheet along said two portions of the perforated tear lines, the advantageous flat center piece can be formed with no fold or bend lines on the piece.

In most cases, the perforated tear line includes at least one transverse perforated portion which allows the separation to be effected by the user at a predetermined transverse line. However this again is not essential and separation may be effected by tearing of the substrate or by separating adhesive joining the adhesive.

Preferably the transverse perforated portion of the perforated tear line or line of weakness is provided through both substrate sheets sufficiently such that an end piece of the channel shaped receptacle, formed by both substrate sheets and including the joining adhesive, can be torn away to leave the center portion of first substrate sheet and the second substrate sheet separated along said transverse perforated portion. However a tear line through only one of the substrate sheets can be used with the user lifting that substrate sheet and tearing it away from the other.

In one preferred arrangement, the perforated tear line extends only part way around the periphery of the portion of the first substrate sheet leaving a part of the periphery of the portion of the first substrate sheet which is free from the tear line, at which the portion of the first substrate sheet remains attached to the second substrate sheet. Thus the two portions of the substrate sheets, while separated to expose the indicia on the inside surfaces, are still connected. This maximizes the area available on the inside surfaces for the indicia of remanent value but provides a product which has a tendency not to remain flat due to the connection line at the adhesive. In most cases, the part of the periphery which is not perforated for tearing is arranged at one end of the channel shaped receptacle. However it is not essential that the non-perforated part be located at one end and it can be located at other positions for example along one side.

In the above preferred arrangement, where the pieces remain connected, the indicia can comprise related indicia printed on both the rear surfaces of the first and second substrate sheets. This is particularly of value where the indicia comprise game indicia covered by a scratch-off layer where the indicia printed on both the rear surfaces of the first and second substrate sheets relate to a common game. However separate games or separate indicia unconnected between the two pieces can be used if preferred.

In order to promote the remanent value to the user, preferably promotional graphics are printed on the front surface of one or both of the first and second substrate sheets. If printing on one surface contacting the product is an issue for hygiene, the printing may be provided only on that substrate, either the first or the second, which is located on the outer surface of the channel shaped receptacle. Of course the printing on the rear or inside surfaces of the substrates has no hygiene issues provided the substrates are selected for food grade materials if required.

Where the remanent indicia relate to a game, game information relating to rules and the like for playing of the game are preferably printed on the front or outer surface of one or both of the first and second substrate sheets, thus maximizing the area on the inside or rear surfaces for actual game indicia.

Where the remanent indicia relate to a game, the indicia printed on the rear surface may comprise game indicia printed by variable image printing, some or all of the game indicia being covered by a layer of scratch-off material removable by a player. The game indicia may be provided on only one or both of the substrate sheets. Where the indicia is on only one, the other may be blank if not required or may contain other indicia unrelated to the game, for example a collectible card or the like.

In an alternative arrangement, the perforation tear line is arranged to separate the first and second substrate sheets each from the other to form two separate sheet portions. Thus the perforation tear line generally will include, in this arrangement, both side portions along the sides of the remanent pieces and two transverse portions one across each end.

Such separate pieces can be used either as separate game cards or as other collectible cards either including valuable remanent data or containing collectible information such as sports cards or the like.

Where the sheet portions formed from the first and second sheets are wholly separated, the perforation tear line is preferably arranged to form two sheet portions of identical size by tearing off side and end pieces. In some cases the sheet portions may be defined by the whole length of the channel shaped receptacle or in other cases, for example where the product is inconveniently long, the sheet portions may be sub-divided into more than one piece preferably by transverse perforation lines.

In the above situation, generally each of the two sheet portions of identical size will have collectible data of remanent value printed on at least the rear surface thereof.

The type of remanent indicia can vary widely and includes data of intrinsic value to the user, promotional cards, product coupons, collectible cards such as sports cards and any others which can be created by the imagination of those in the promotional industry.

Where the remanent indicia relate to a game, the game may be for prizes both monetary and product related or may be merely for entertainment where no gambling or prize is involved. The type and value of any prizes can vary widely. The games may be pre-determined, otherwise known as "instant win" tickets or may include elements of skill or chance. The games may include a scratch-off-coating which is convenient and effective particularly for instant win type game tickets, but other types of games which do not include scratch-off may be used.

In addition to the above completed packaged product, it is one object of this invention also to provide a packaging material which is designed and arranged for use in producing the above product.

According to a second aspect of the invention therefore there is provided a packaging material for forming a channel shaped receptacle for receiving and supporting a structure to be packaged by an over-wrap material covering the channel shaped receptacle and the structure thereon, where the channel shaped receptacle has a bottom wall on which the structure sits, with two side edges and two end edges defining a width and length of the bottom wall generally matching a width and length of the structure and two upstanding side walls each connected along a respective side edge of the bottom wall so as to stand upwardly therefrom to a height to provide protection for sides of the structure;

the packaging material comprising:

a first substrate sheet having a front surface and a rear surface;

a second substrate sheet having a front surface and a rear surface;

the first and second substrate sheets being coextensive, with the rear surface of the first substrate sheet being connected to the rear surface of the second substrate sheet to form a common assembly for forming the channel shaped receptacle;

the first and second substrate sheets defining a center portion and two side strip portions where the center portion has a width arranged to form the bottom wall and the two side strip portions each have a width arranged to form a respective one of the upstanding side walls;

the rear surfaces of the first and second substrate sheets being connected by adhesive within the side strip portions leaving the center portions unconnected;

the rear surface the center portion of at least one of the first and second substrate sheets having printed thereon indicia providing a remanent value therefor.

Preferably the substrate sheets are formed in a continuous strip defining a continuous row of individual packaging elements each arranged to form an individual channel shaped receptacle having a length matching that of the structure to be packaged, wherein each individual packaging element is separated from the next by a transverse strip of adhesive which connects the first substrate sheet to the second substrate sheet. Such a continuous strip is conveniently rolled for unrolling at a packaging machine. However the strip may be fan folded. In addition, depending upon the requirements of the packaging machine, the elements may be supplied individually in a stack each for use with a separate packaged product.

Depending upon the requirements of the packaging machine, some or all of the required perforations may be applied in the strip prior to supply. Typically such packaging machines include perforating rollers which form the junction line between the side walls and the bottom wall of the channel shaped receptacle. Where this is the case, these side portions of the perforations may be applied on line with any prior perforations in the strip being limited to one or two transverse perforations lines as required.

While the actual perforation lines forming the junction between the side walls and the center portion defining the bottom wall are formed on the packaging line, it is desirable to correlate in the supplied strip the location of the center portion and the remanent indicia printed thereon so that when the lines are formed and the packaging material opened by the purchaser, the removal of the side portions leaves the center portion alone but intact.

BRIEF DESCRIPTION OF THE DRAWINGS

One embodiment of the invention will now be described in conjunction with the accompanying drawings in which.

In the drawings like characters of reference indicate corresponding parts in the different figures.

DESCRIPTION OF THE PREFERRED EMBODIMENTS

DETAILED DESCRIPTION

Figure 1:
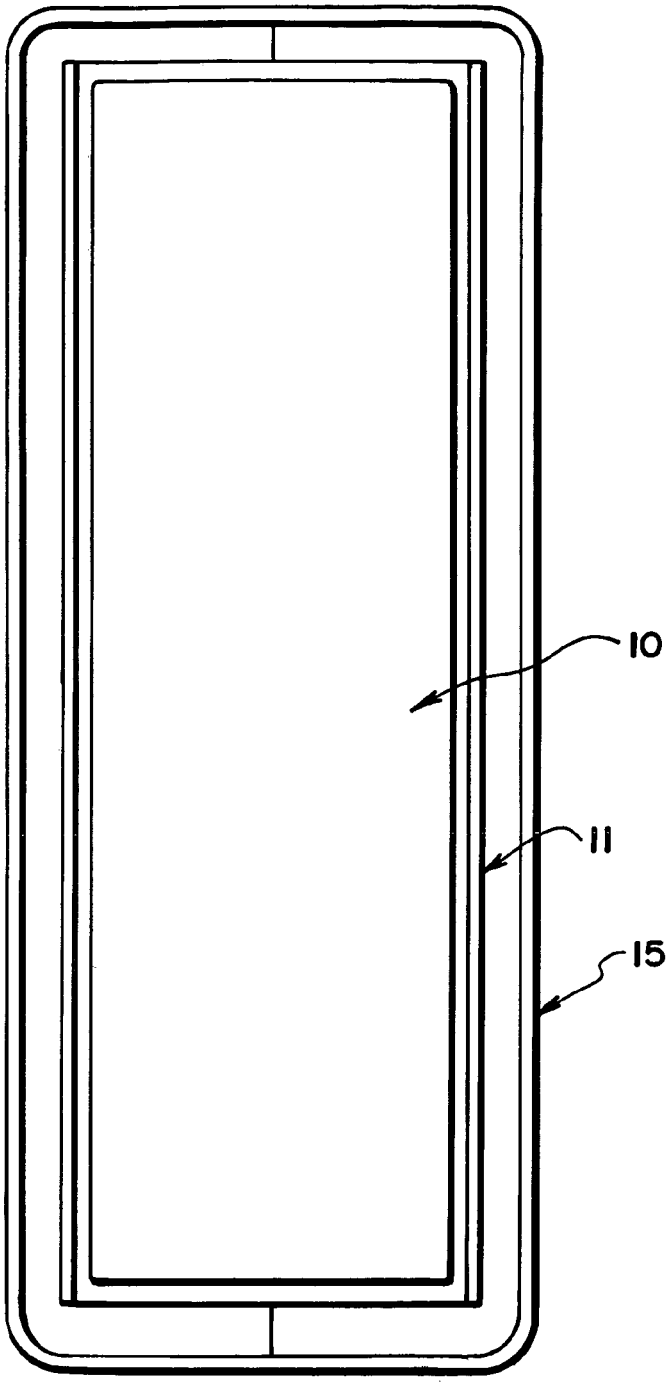
FIG. 1 is a top plan view of a packaged product according to the present invention.
Figure 2:
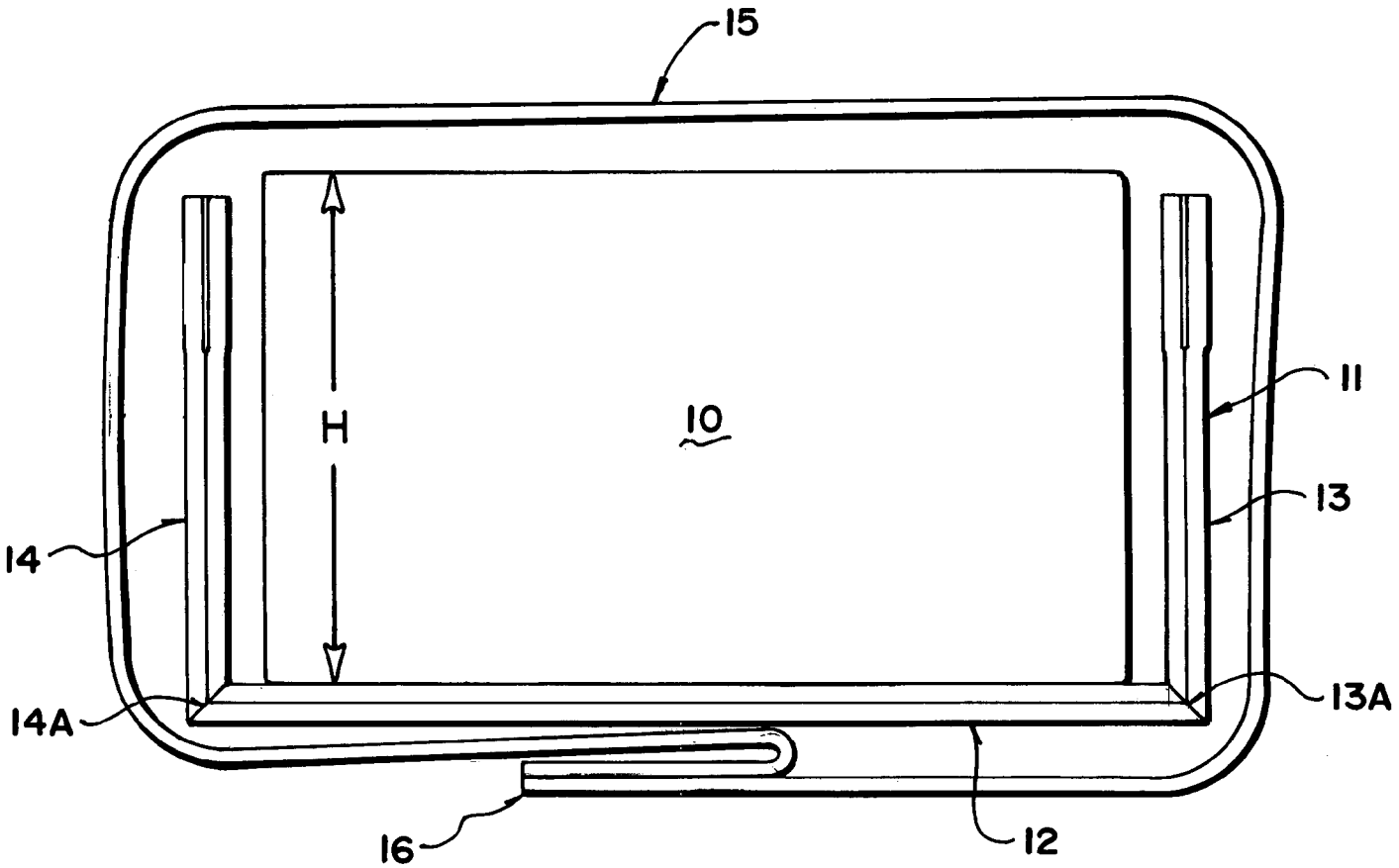
FIG. 2 is a transverse cross-sectional view of the packaged product of FIG. 1.

In FIGS. 1 and 2 is shown a wrapped product utilizing a packaging element according to the present invention so as to provide a construction which is also in accordance with the present invention. The wrapped product comprises a product 10 which is shown as an elongate rectangular body but can be of any shape and may include a series of separate elements. The product is contained within a channel shaped receptacle 11 having a bottom wall 12 underlying the product 10 and having two upstanding side walls 13 and 14 each standing up along a respective side of the product 10. The width and length of the bottom wall 12 is matched approximately or generally to the width and length of the product. The upstanding side walls 13 and 14 are of a height so that they provide some protection for the sides of the product. The height as shown is approximately equal to the height of the product but it is not necessary that the height match the height of the product since the existence of the side walls and the stiffness provided by the channel shaped receptacle 11 due to the bends between the side walls and the bottom wall provide protection for the product as is well known.

The product carried within the channel shaped receptacle is wrapped by a thin overwrap material 15 which surrounds the complete product and the receptacle and forms a thin seal 16 along the bottom surface underneath the bottom wall 12.

Packaged products of this type are well known and this type of packaging is used for many different types of products. Commonly it can be seen in the packaging of candy bars where a single candy bar sits in the channel shaped receptacle and is enclosed by the overwrap material. Sometimes the channel shaped receptacle receives two candy bars end to end or in other cases more than two can be elements are arranged in a row along the channel shaped receptacle and held together by the overwrap material.

Conventionally the channel shaped receptacle is formed of card manufactured to food grade so that an inside surface of the card contacts the bottom and sides of the product directly with the overwrap material providing the necessary hygienic sealed enclosure.

According to the embodiments described herein, the channel shaped receptacle is replaced by a modified construction which provides printed cards or printed tickets forming remanent value for the packaging element when it is removed from the package.

Figure 3:
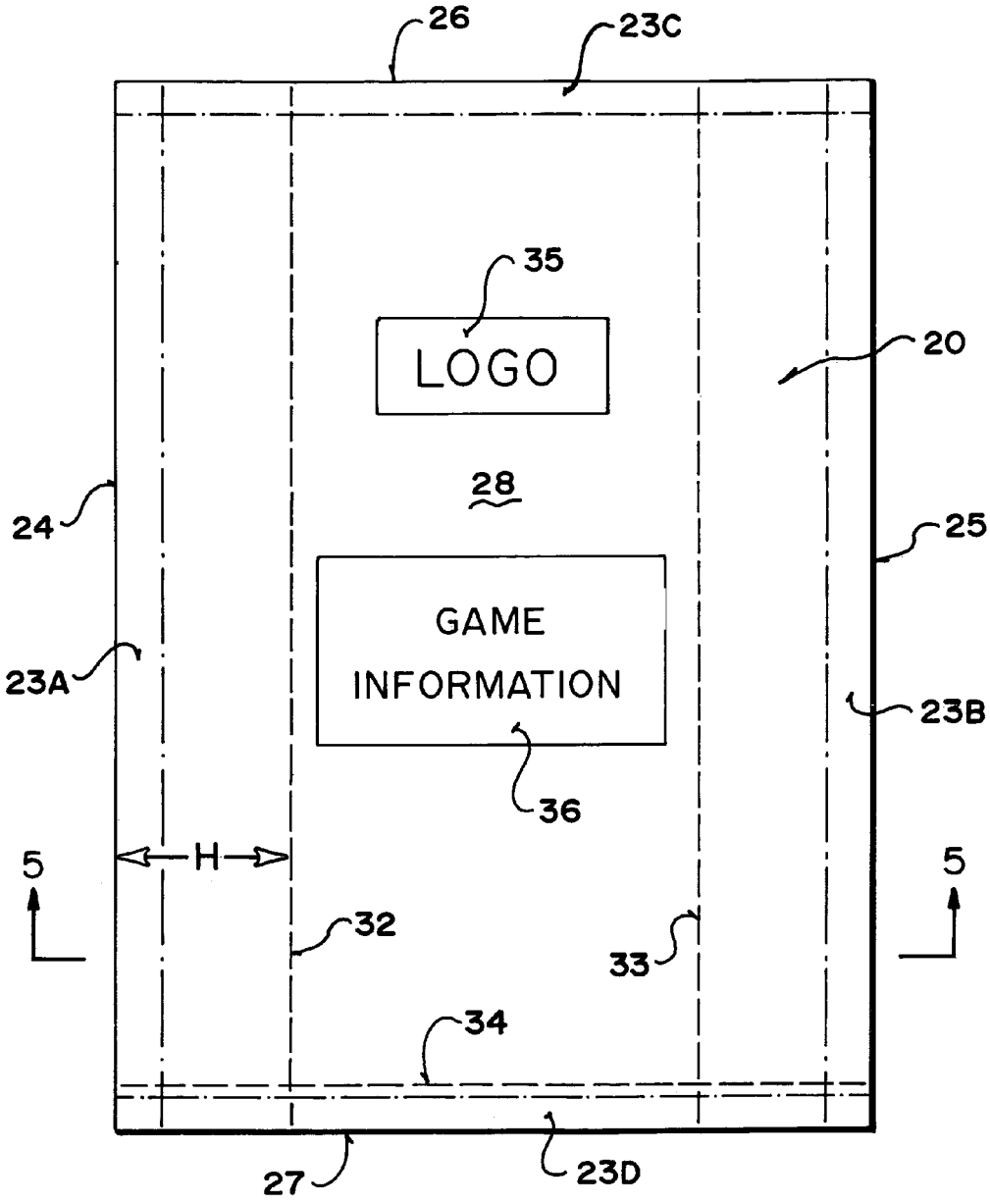
FIG. 3 is a bottom plan view of one example of packaging element, for use in containing the packaged product of FIGS. 1 and 2, according to the present invention showing the front or bottom surface of first substrate sheet.
Figure 4:
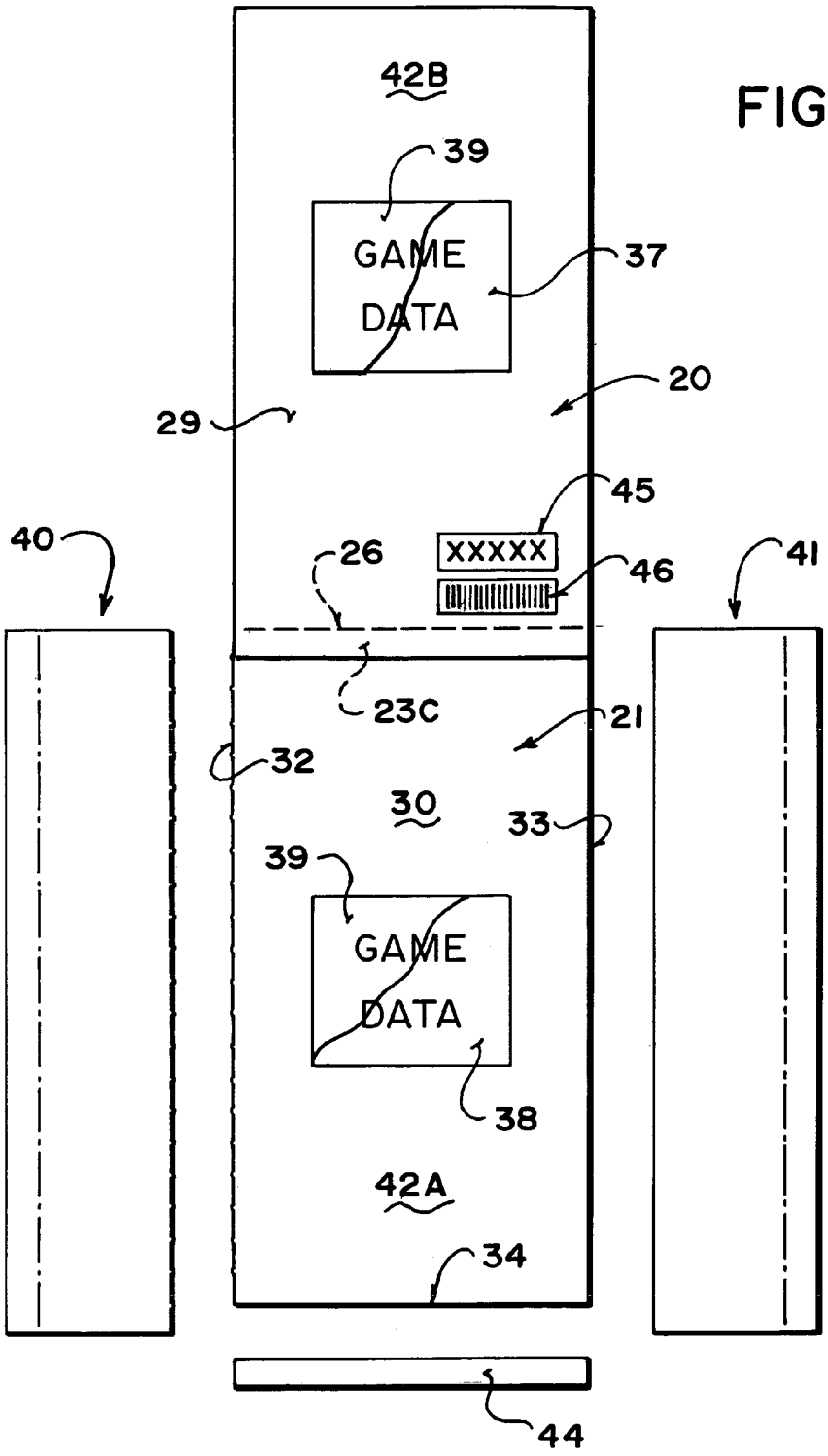
FIG. 4 is a top plan view of the packaging element of FIG. 4 after separation to expose the game data on the rear or inside surface of the first and second substrate sheets.
Figure 5:
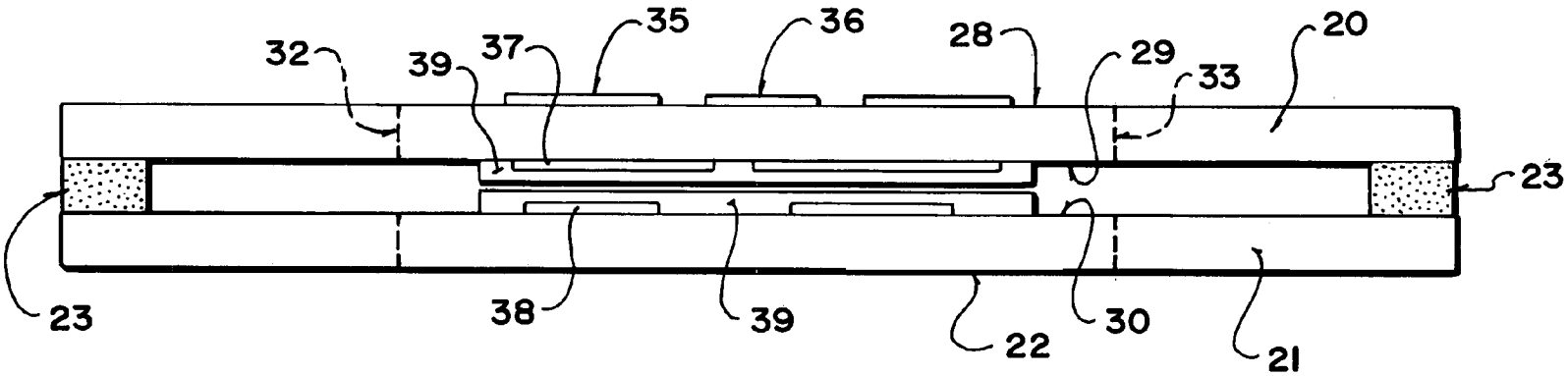
FIG. 5 is a cross-sectional view along the lines 5—5 of FIG. 3.

Thus the construction shown in FIGS. 3, 4 and 5 forms a packaging element for replacement of the conventional channel shaped receptacle of the conventional packaging materials.

The packaging element shown in these figures is formed from a first substrate 20 and a second substrate 21. Although the substrates shown with the first uppermost, it will be appreciated that in many cases the product can be inverted since it is in many cases symmetrical. In other cases one of the substrates may form a smooth flat unprinted surface 22 which can be used to contact the food product in cases where printing layers or other layers applied on to the substrate would be undesirable for such food products.

In FIGS. 3, 4 and 5 is shown a single packaging element which has been cut to form the element for use in the packaging process. In many cases the packaging elements will be supplied as a continuous row as described hereinafter. The cutting to separate each from the next can be carried on prior to supply or as part of the process on the packaging line as is convenient for the particular arrangement of packaging line used to package the product. The following description therefore relates to the individual packaging element when separated and cut for use in the finished package product described above.

The packaging element therefore formed by the first and second substrate layers 20 and 21 is formed into a composite construction by the co-extensive substrates being bonded each to the other by a band of adhesive 23 arranged around the periphery of the substrates adjacent the edges of the substrates. Thus the substrates have two side strips 23A and 23B of the adhesive each along a respective side edge 24, 25 of the substrate. Further the substrates have transverse lines of adhesive 23C and 23D arranged along end edges 26 and 27 of the substrates respectively. The substrates thus formed into the laminate structure provide an outside surface or front surface including the surface 28 of the substrate 20 and the surface 22 of the substrate 21. Also the substrates provide an inside or rear surface 29 of the substrate 20 and 30 of the substrate 21. The surfaces 29 and 30 are fully enclosed by the strips of adhesive so that they are not accessible at this time to a person accessing the packaging element.

The packaging element further includes perforated lines of weakness 32 and 33 arranged along the length of the packaging element parallel to the side edges 24 and 25. Further the packaging element includes a transverse line of weakness 34 adjacent to or at the strip of adhesive 23D adjacent the edge 27. It will be noted that the line of weakness is positioned slightly beyond the band of adhesive so that the laminate at the position beyond the line of weakness is entirely free from the adhesive and can be separated at that location. It will be noted that there is no perforated line of weakness at the adhesive band 23 adjacent the edge 26 corresponding to the line 34.

In one embodiment the lines of weakness 32, 33 are provided through both of the substrates 20 and 21 so that both can be readily torn along that line of weakness. In an alternative embodiment (not shown) only the upper one 20 of the substrates is perforated at the line of weakness thus allowing the upper substrate to be torn while the lower substrate remains intact.

The lines of weakness 32 and 33 are arranged so that they are located directly at the bend or fold lines 13A 14A in the package structure shown in FIG. 2. Thus the lines of weakness 32 and 33 are arranged either on the packaging line or an initial supply of the package elements to be located at a position directly matching the intended location of the fold lines 13A and 14A. Thus the lines of weakness 32 and 33 are arranged to perform two functions and thus are manufactured or formed using forming techniques, one well known to one skilled in the art, which perform both of these functions. The first function is to allow the bend or fold lines 13A, 14A to be formed readily thus allowing the channel shaped member to be bent or folded into the channel shape from an initial flat condition. Secondly the lines of weakness 32, 33 are arranged to allow the tearing of the substrates, either one or both of the substrates in a clean tearing action along the line of weakness.

Thus it will be noted from FIGS. 2 and 3 that the width of the laminate from the line 32 to the edge 24 as indicated at H is equal to the height of the side walls in the package structure shown in FIG. 2.

As shown in FIG. 3, at least the surface 28 has printed thereon product information and or graphics 35 together with data or indicia 36 relating to the remanent value of the card or ticket.

In the embodiment of FIGS. 3 and 4, the remanent value relates to a game intended to be played by the user after purchase of the product and consumption of the product thus leaving the packaging material and particularly the packaging element available for further use. In this case the printed information on the surface 28 as indicated at 36 relates to rules or other information concerning the game to be played.

The actual game to be played is printed on the rear or inside surfaces 29 and 30 of the substrates 20 and 21 as best shown in FIG. 4. The game data is printed on the inside surface as indicated at 37 and 38. The game data is covered by a scratch off coating 39 which is shown partly removed during playing of the game. Various types of games can be used as is well known to one skilled in the art where game indicia can be exposed or marked by scratching a latex coating printed onto the game indicia on top of the surface of the substrate. The covering of the game indicia 37 and 38 by the latex or other scratch off coating is best shown in FIG. 5.

When the packaging element is exposed and removed from the packaging after consumption of the product, the side portions 40 and 41 defined by tearing along the lines of weakness 32 and 33 can be directly removed from the laminate structure forming the packaging element. This removal is often effected by initially weakening the line of weakness by bending the laminate back and forth at the line of weakness so as to stretch the connecting points along the line of weakness and further define the line of weakness sufficiently to allow the manual tearing of the portions 40 and 41 without the danger of the tear propagating into the portions themselves or the remaining element of the substrate between those portions. Thus it will be noted that when the portions 40 and 41 have been torn away, this leaves a central portion 42A and 42B of the substrates 20 and 21. As the removed strips 40 and 41 are substantially equal to the height of the side walls of the packaging element, the remaining center portions 42A and 42B are substantially equal in width to the bottom wall 12 of the packaging element.

With the side strips torn away, a bottom strip portion 44 defined beyond the line of weakness 34 can also be torn away, again using the bending back and forth technique to weaken the line of weakness if necessary.

When torn away from the line of weakness 34, it will be appreciated that the center portions 42A and 42B can be opened up to expose the inside or rear surfaces 29 and 30 as shown in FIG. 4. The substrates 20 and 21 remain connected by the strip of adhesive 23C. This opening of the substrates 20 and 21 exposes the game data 37 and 38 allowing the game to be played in conventional manner. One or both of the substrate pieces 20, 21 can carry a validation number 45 and a bar code 46 as is conventionally known.

The game data 37 and 38 is preferably related to a common game format so that the game data of one surface 29 is related to the game data of the second surface 30 in a common game.

Depending upon the game, only one of the surfaces 29 and 30 may contain actual playing game data including a scratch off coating whereas the other may include game elements to be played or other information relating to the common game. In a yet further alternative, the games defined by the game data 37 and 38 may be entirely separate and played entirely separately.

In another alternative (not shown) a second transverse line of weakness is provided at the adhesive band 23C so as to provide a tear off strip symmetrical to the tear off strip 44 at the end 26 thus allowing the substrate pieces 20 and 21 defined by the center sections 42A and 42B to be entirely separated one from the next to provide two separate game elements which are entirely independent and played independently.

In a further alternative (not shown), the lines of weakness 32, 33 and 34 may extend only through one of the substrate sheets so that the user lifts up the substrate sheet which is separated and pulls it away from the underlying substrate sheet without separating the strips 40 and 41 and thus maintaining the structure intact. This arrangement may be more desirable to avoid formation of little pieces of waste material which can be discarded inappropriately since the structure in this embodiment is maintained integral but the tearing action simply exposes the inside surface of the center portions 42A and 42B for playing of the game. In a yet further arrangement, the lines of perforation or weakness include the lines 32, 33 and 34 together with a yet further line across the adhesive band 23C whereas each of the lines of weakness extends only through one substrate allowing that substrate portion 42B to be torn wholly away from the remaining underlying structure comprising the portion 42A which remains connected to the portions 40, 41 and 44.

Figure 6:
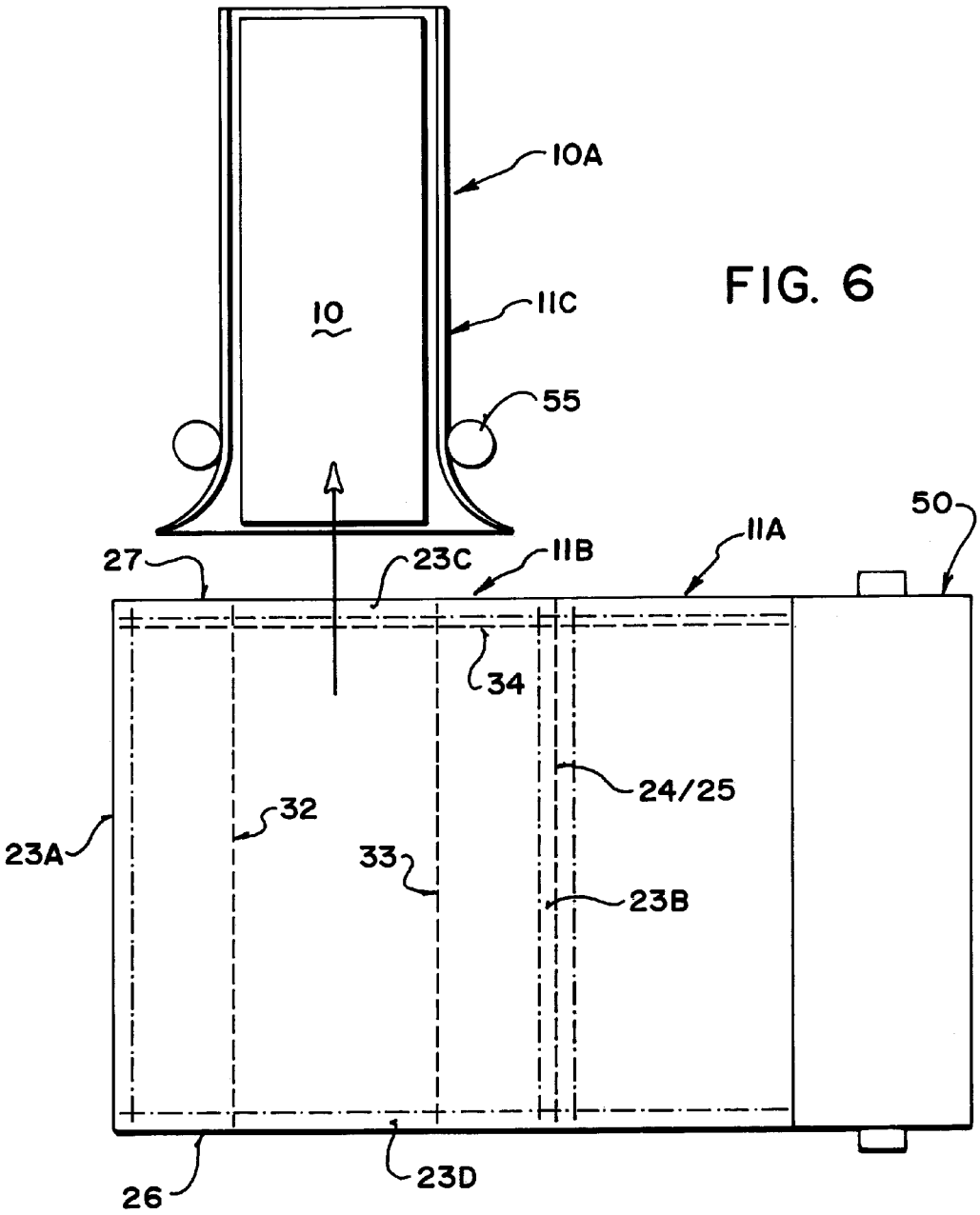
FIG. 6 is a top plan view showing schematically a method of wrapping the product of FIG. 1 using a rolled supply of the packaging elements of FIGS. 3, 4 and 5.
Figure 7:
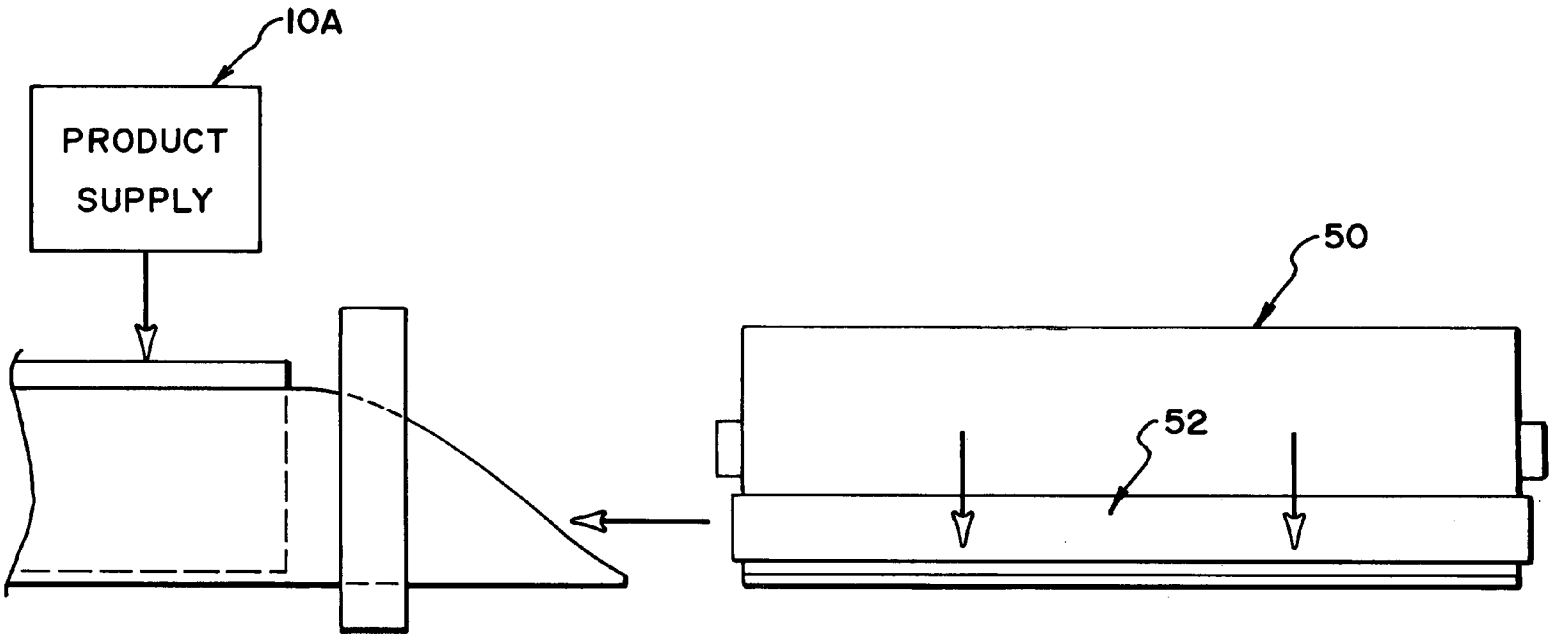
FIG. 7 is a side elevational view of the schematic method of FIG. 6.

Turning now to FIGS. 6 and 7 there is shown schematically a packaging line for forming the packaging elements and package structures described above. Thus in FIGS. 6 and 7 is shown a roll 50 defining a continuous supply of the packaging elements connected end to end. The packaging elements include the substrates 20 and 21 as previously described which are connected by the bands of adhesive 23. In FIG. 6 is shown three separate packaging elements indicated at 11A, 11B and 11C respectively in a row running downstream from the roll 50. The third package element 11C is shown engaged around the product 10.

In this embodiment the substrates 20 and 21 are printed with all of the data concerned as described above. The roll of the substrates is supplied in a direction at right angles to the final use in that the side edges of the strip on the roll are defined by the front and rear edges 26 and 27 and the only pre-cut line provides the transverse line of weakness 34.

In the packaging line, the lines of weakness 33 and 32 are formed by a die cutter 51 of a conventional nature well known to one skilled in the art which includes perforating edges which act to provide the necessary perforations as previously described. The die cutter includes a cutting element 53 which is located so as to effect a transverse cutting action to separate each packaging element from the next as they are fed from the roll 50. The cutting element 53 is timed to operate so that it cuts along a line 24/24 which is shown schematically in FIG. 6 which is the intended line of separation of one packaging element from the next. In FIG. 6 it will be noted that a separation of the packaging element has occurred at the junction between the packaging element 11B and the packaging element 11C allowing the packaging element to be moved at right angles to the supply line into register with the product supply shown schematically at 10A.

Folding rollers 55 are provided which guide the bending action of the packaging element so as to provide the bending at the lines 32 and 33 to form the packaging element into the channel shaped receptacle necessary to receive the product 10. The product 10 is supplied from a product supply 10A which is again shown schematically.

The details of the packaging line of this nature are well known to one skilled in the art so that they are shown only schematically herein.

Further details concerning the construction and method of manufacture of the laminate structure forming the packaging elements is shown in U.S. Pat. No. 6,234,477 of the present Assignee to which reference can be made for further details of this construction as required by the reader.

Figure 8:
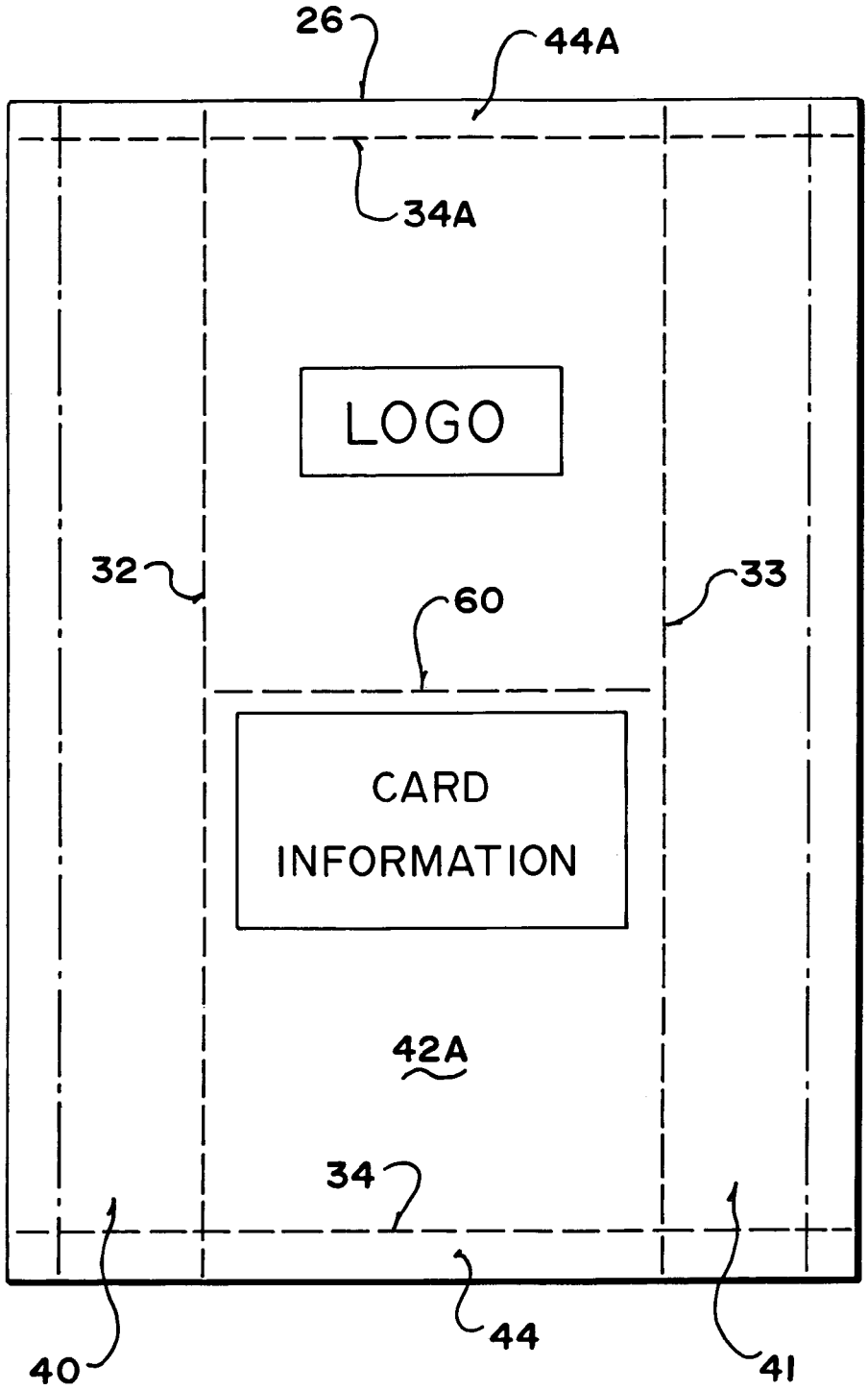
FIG. 8 is a bottom plan view of a second example of packaging element, for use in containing the packaged product of FIGS. 1 and 2, according to the present invention showing the front or bottom surface of first substrate sheet.
Figure 9:
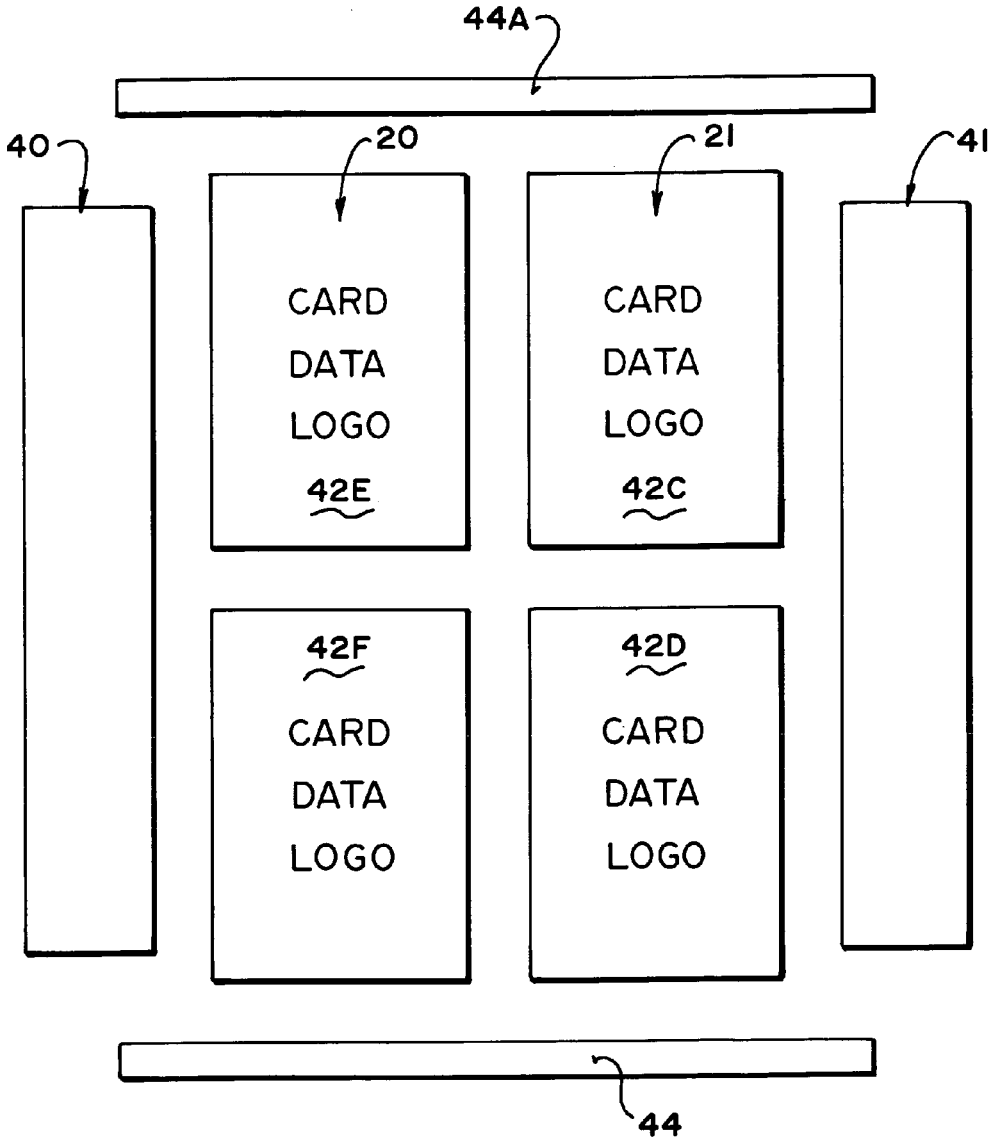
FIG. 9 is a top plan view of the packaging element of FIG. 8 after separation to expose the card data on the rear or inside surface of the first and second substrate sheets.

Turning now to FIGS. 8 and 9 there is shown another example of a packaging element similar to that previously described. In this embodiment, the center portions of the laminate as indicated at 42A in FIG. 8 are completely separated by separation of the laminates 20 and 21 by the four lines of weakness 32, 33, 34 and 34A where the line 34A is symmetrical to the line 34 but at the opposite edge 26. This allows the four pieces 40, 41, 44 and 44A to be torn away as shown in FIG. 9. In this embodiment it will be noted that the end pieces 44 and 44A are torn away first so that they have a width equal to the full width of the packaging element since it will be appreciated that the tearing action can be effected in either direction first. However this is generally not the preferred In the embodiment shown in FIG. 9, after separation of the center pieces from the surrounding tear off pieces, four individual cards can be formed as indicated at 42C, 42D, 42E and 42F. These individual cards are formed from the first and second sheets 20 and 21 together with a further transverse line of weakness 60.

In this embodiment, rather than providing a game as a residual value, the residual value is provided by a series of collectible cards of those well known to one skilled in the art. Such collectible cards often include sports data, sports personalities, entertainment or celebrity personalities and the like with the intention that the cards be collectible, traded and formed into a complete set. This technique of course has high promotional value and can use any of the licensable information or data available for collectible cards as is well known to one skilled in the art and as is available to the imagination of the person skilled in the promotional business.

The reason for dividing the center pieces 42A and 42B from the sheets 20 and 21 into separate cards 42C, 42D, 42E and 42F is that the length of the packaging element may be inconvenient or unsuitable to match the conventional length of a collectible card so that additional separation may be desirable. However this is of course not necessary and the complete center portion may be formed as the collectible item regardless of its shape. In this embodiment it is highly desirable that the side pieces 40 and 41 be fully torn away so that the completed card is formed only from the center section and thus is entirely flat for collection as a set of flat collectible cards.

While the preferred embodiments of the invention have been described above, it will be recognized and understood that various modifications may be made therein, and the appended claims are intended to cover all such modifications which may fall within the spirit and scope of the invention.

The invention claimed is:

1. A packaged product comprising:

at least one product arranged to form a structure to be packaged;

a channel shaped receptacle for receiving and supporting the structure to be packaged;

the channel shaped receptacle having a bottom wall on which the structure sits, with two side edges and two end edges defining a width and length of the bottom wall generally matching a width and length of the structure;

the channel shaped receptacle having two upstanding side walls each connected along a respective side edge of the bottom wall so as to stand upwardly therefrom to a height to provide protection for sides of the structure;

and an over-wrap material covering the channel shaped receptacle and the structure thereon;

the channel shaped receptacle comprising:

a first sheet having a front surface and a rear surface;

a second sheet having a front surface and a rear surface;

the rear surface of at least one of the first and second sheets having printed thereon indicia providing a remanent value therefor;

the first and second sheets being coextensive so as to define side and end edges of the first sheet which overlie side and end edges of the second sheet;

with the rear surface of the first sheet being connected to the rear surface of the second sheet along the side and end edges by an adhesive strip to form a common assembly with a hollow interior closed by the adhesive strips at the connected side and end edges, which common assembly forms the channel shaped receptacle including the bottom wall and the two upstanding side walls;

either the first sheet alone or both sheets being perforated to define a perforated tear line thereon arranged to define a portion of the first sheet which can be opened relative to the second sheet, by a user tearing through the perforated tear line, to expose the indicia.

2. The packaged product according to claim 1 wherein two side portions of the perforated tear line are arranged respectively along the side edges of the bottom wall.

3. The packaged product according to claim 2 wherein the two portions of the perforated tear line along the side edges of the bottom wall are arranged such that the channel shaped receptacle can be torn along the side edges of the bottom wall to simultaneously remove the upstanding side walls and separate the first sheet from the second sheet along said two portions of the perforated tear lines.

4. The packaged product according to claim 1 wherein the perforated tear line includes at least one transverse perforated portion.

5. The packaged product according to claim 4 wherein the transverse perforated portion of the perforated tear line is arranged such that an end piece of the channel shaped receptacle can be torn away to separate the first sheet from the second sheet along said transverse perforated portion.

6. The packaged product according to claim 1 wherein the perforated tear line extends only part way around the periphery of the portion of the first sheet leaving a part of the periphery of the portion of the first sheet which is free from the tear line, at which the portion of the first sheet remains attached to the second sheet.

7. The packaged product according to claim 6 wherein the indicia comprise related indicia printed on both the rear surfaces of the first and second sheets.

8. The packaged product according to claim 6 wherein the indicia comprise game indicia covered by a scratch-off layer where the indicia printed on both the rear surfaces of the first and second sheets relate to a common game.

9. The packaged product according to claim 1 wherein promotional graphics are printed on said front surface of one or both of the first and second sheets.

10. The packaged product according to claim 1 wherein game information is printed on said front surface of one or both of the first and second sheets.

11. The packaged product according to claim 1 wherein the indicia printed on the rear surface of at least one of the sheets comprises game indicia printed by variable image printing, some or all of the game indicia being covered by a layer of scratch-off material removable by a player.

12. The packaged product according to claim 1 wherein the indicia comprises first game indicia printed by variable image printing onto said rear surface of said first sheet, some or all of the first game indicia being covered by a layer of scratch-off material removable by a player; and second game indicia printed by variable image printing onto said rear surface of said second sheet, some or all of the second game indicia being covered by a layer of scratch-off material removable by the player.

13. The packaged product according to claim 1 wherein the perforation tear line is arranged to separate the first and second sheets each from the other to form two separate sheet portions.

14. A packaged product comprising:

at least one product arranged to form a structure to be packaged;

a channel shaped receptacle for receiving and supporting the structure to be packaged;

the channel shaped receptacle having a bottom wall on which the structure sits, with two side edges and two end edges defining a width and length of the bottom wall generally matching a width and length of the structure;

the channel shaped receptacle having two upstanding side walls each connected along a respective side edge of the bottom wall so as to stand upwardly therefrom to a height to provide protection for sides of the structure;

and an over-wrap material covering the channel shaped receptacle and the structure thereon;

the channel shaped receptacle comprising:

a first sheet having a front surface and a rear surface;

a second sheet having a front surface and a rear surface;

the rear surface of at least one of the first and second sheets having printed thereon indicia providing a remanent value therefor;

with the rear surface of the first sheet being connected to the rear surface of the second sheet to form a common assembly, which assembly forms the channel shaped receptacle including the bottom wall and the two upstanding side walls;

either the first sheet alone or both sheets being perforated to define a perforated tear line thereon arranged to define a portion of the first sheet which can be opened relative to the second sheet, by a user tearing through the perforated tear line, to expose the indicia;

wherein the perforation tear line is arranged to form, from the first sheet a first sheet portion and from the second sheet a second sheet portion, where the two sheet portions are of identical shape and size, by tearing off side and end pieces.

15. The packaged product according to claim 14 wherein the two sheet portions of identical shape and size both have collectible data of remanent value printed on at least the rear surface thereof.

16. A packaged product comprising:

at least one product arranged to form a structure to be packaged;

a channel shaped receptacle for receiving and supporting the structure to be packaged;

the channel shaped receptacle having a bottom wall on which the structure sits, with two side edges and two end edges defining a width and length of the bottom wall generally matching a width and length of the structure;

the channel shaped receptacle having two upstanding side walls each connected along a respective side edge of the bottom wall so as to stand upwardly therefrom to a height to provide protection for sides of the structure;

and an over-wrap material covering the channel shaped receptacle and the structure thereon;

the channel shaped receptacle comprising:

a first sheet having a front surface and a rear surface;

a second sheet having a front surface and a rear surface;

the rear surface of at both of the first and second sheets having printed thereon indicia providing a remanent value therefor;

with the rear surface of the first sheet being connected to the rear surface of the second sheet to form a common assembly, which assembly forms the channel shaped receptacle including the bottom wall and the two upstanding side walls;

the first and second sheets being arranged such that the indicia on the rear surface of the first sheet are covered by the second sheet and the indicia on the rear surface of the second sheet are covered by the first sheet;

either the first sheet alone or both sheets being perforated to define a perforated tear line thereon arranged to define a portion of the first sheet which can be opened relative to the second sheet, by a user tearing through the perforated tear line, to expose the indicia.

17. The packaged product according to claim 16 wherein the indicia comprises first game indicia printed by variable image printing onto said rear surface of said first sheet, some or all of the first game indicia being covered by a layer of scratch-off material removable by a player; and second game indicia printed by variable image printing onto said rear surface of said second sheet, some or all of the second game indicia being covered by a layer of scratch-off material removable by the player.

18. The packaged product according to claim 16 wherein the perforation tear line is arranged to separate the first and second sheets each from the other to form two separate sheet portions.

19. A packaged product comprising:

at least one product arranged to form a structure to be packaged;

a channel shaped receptacle for receiving and supporting the structure to be packaged;

the channel shaped receptacle having a bottom wall on which the structure sits, with two side edges and two end edges defining a width and length of the bottom wall generally matching a width and length of the structure;

the channel shaped receptacle having two upstanding side walls each connected along a respective side edge of the bottom wall so as to stand upwardly therefrom to a height to provide protection for sides of the structure;

and an over-wrap material covering the channel shaped receptacle and the structure thereon;

the channel shaped receptacle comprising:

a first sheet having a front surface and a rear surface;

a second sheet having a front surface and a rear surface;

the rear surface of both of the first and second sheets having printed thereon indicia providing at least one game to be played by a user;

with the rear surface of the first sheet being connected to the rear surface of the second sheet to form a common assembly, which assembly forms the channel shaped receptacle including the bottom wall and the two upstanding side walls;

both the first and second sheets being perforated to define a perforated tear line thereon along which the sheets can be torn by a user to allow a portion of the first sheet to be opened relative to the second sheet to expose the indicia on both of the sheets;

wherein the perforated tear line includes two portions each along a respective one of the side edges of the bottom wall arranged such that the channel shaped receptacle can be torn along the side edges of the bottom wall to simultaneously remove the upstanding side walls and leave the bottom wall;

and wherein the indicia for the at least one game are printed only the bottom portion and thus remain available for playing the game when the side walls are removed.

20. The packaged product according to claim 19 wherein the perforated tear line includes at least one transverse perforated portion.

21. The packaged product according to claim 20 wherein the transverse perforated portion of the perforated tear line is arranged such that an end piece of the channel shaped receptacle can be torn away to separate the first sheet from the second sheet along said transverse perforated portion.

22. The packaged product according to claim 19 wherein the perforated tear line extends only part way around the periphery of the portion of the first sheet leaving a part of the periphery of the portion of the first sheet which is free from the tear line, at which the portion of the first sheet remains attached to the second sheet.

23. The packaged product according to claim 19 wherein the indicia comprise game indicia covered by a scratch-off layer where the indicia printed on both the rear surfaces of the first and second sheets relate to a common game.

24. The packaged product according to claim 19 wherein promotional graphics are printed on said front surface of one or both of the first and second sheets.

25. The packaged product according to claim 19 wherein the indicia printed on the rear surface of at least one of the sheets comprises game indicia printed by variable image printing, some or all of the game indicia being covered by a layer of scratch-off material removable by a player.

26. A packaged product comprising:

at least one product arranged to form a structure to be packaged;

a channel shaped receptacle for receiving and supporting the structure to be packaged;

the channel shaped receptacle having a bottom wall on which the structure sits, with two side edges and two end edges defining a width and length of the bottom wall generally matching a width and length of the structure;

the channel shaped receptacle having two upstanding side walls each connected along a respective side edge of the bottom wall so as to stand upwardly therefrom to a height to provide protection for sides of the structure;

and an over-wrap material covering the channel shaped receptacle and the structure thereon;

the channel shaped receptacle comprising:

a first sheet having a front surface and a rear surface;

a second sheet having a front surface and a rear surface;

the rear surface of at both of the first and second sheets having printed thereon indicia providing at least one game to be played by a user;

wherein the indicia comprise game indicia at least some of which is covered by a scratch-off layer removable by the user;

with the rear surface of the first sheet being connected to the rear surface of the second sheet to form a common assembly, which assembly forms the channel shaped receptacle including the bottom wall and the two upstanding side walls;

either the first sheet alone or both sheets being perforated to define a perforated tear line thereon arranged to define a portion of the first sheet which can be opened relative to the second sheet, by a user tearing through the perforated tear line, to expose the indicia.

27. The packaged product according to claim 26 wherein two side portions of the perforated tear line are arranged respectively along the side edges of the bottom wall such that the channel shaped receptacle can be torn along the side edges of the bottom wall to simultaneously remove the upstanding side walls and separate the first sheet from the second sheet along said two portions of the perforated tear lines.

28. The packaged product according to claim 26 wherein the perforated tear line extends only part way around the periphery of the portion of the first sheet leaving a part of the periphery of the portion of the first sheet which is free from the tear line, at which the portion of the first sheet remains attached to the second sheet.

29. The packaged product according to claim 26 wherein the indicia comprises first game indicia printed by variable image printing onto said rear surface of said first sheet, some or all of the first game indicia being covered by a layer of scratch-off material removable by a player; and second game indicia printed by variable image printing onto said rear surface of said second sheet, some or all of the second game indicia being covered by a layer of scratch-off material removable by the player.

* * * * *